United States Patent [19]

Okuno et al.

[11] Patent Number: 4,776,712

[45] Date of Patent: Oct. 11, 1988

[54] INK-DOT PRINTER

[75] Inventors: Shigeru Okuno; Yoshihiro Torisawa, both of Mishima; Mitsuharu Endo, Susono; Tetsuroh Nakayama, Mishima; Masashi Shimosato, Shizuoka; Takafumi Fukushima, Fuji, all of Japan

[73] Assignee: Tokyo Electric Co., Ltd., Tokyo, Japan

[21] Appl. No.: 789,619

[22] Filed: Oct. 21, 1985

[30] Foreign Application Priority Data

Oct. 25, 1984 [JP] Japan ..... 59-224385
Oct. 25, 1984 [JP] Japan ..... 59-224386

[51] Int. Cl.[4] ..... B41J 3/10

[52] U.S. Cl. ..... 400/124; 400/470; 101/93.05; 346/140 R

[58] Field of Search ..... 400/121, 124, 119, 174, 400/470; 101/DIG. 13, 93.04, 93.05; 346/140 R

[56] References Cited

U.S. PATENT DOCUMENTS

| | | | |
|---|---|---|---|
| 4,545,694 | 10/1985 | Niromiya et al. | 400/470 X |
| 4,552,469 | 11/1985 | Tsuge et al. | 400/119 |
| 4,599,629 | 7/1986 | Tsuge et al. | 400/124 X |

FOREIGN PATENT DOCUMENTS

| | | | |
|---|---|---|---|
| 0083249 | 7/1983 | European Pat. Off. | 400/124 |
| 3019012 | 11/1980 | Fed. Rep. of Germany | 400/124 |
| 54-85029 | 7/1979 | Japan | 400/124 |
| 20464 | 2/1983 | Japan | 400/124 |
| 215366 | 12/1983 | Japan | 400/470 |
| 101372 | 6/1984 | Japan | 400/470 |
| 229351 | 12/1984 | Japan | 400/124 |
| 92862 | 5/1985 | Japan | 400/124 |

OTHER PUBLICATIONS

Patent Abstracts of Japan, vol. 9, No. 11 (M-351) (1734), 18th Jan. 1985; & JP-A-59 159 355 (Matsushita Denki Sangyo KK) 8/9/84 (Cat. X).

*Primary Examiner*—David Wiecking
*Assistant Examiner*—James R. McDaniel
*Attorney, Agent, or Firm*—Frishauf, Holtz, Goodman & Woodward

[57] ABSTRACT

An ink-dot printer comprises a recording paper, at least one needle disposed in one side the recording paper and movable between a rest position remote from the recording paper and a projected position close to the recording paper, a driving mechanism for moving the needle between the rest position and the projected position, a driving control unit electrically connected to the driving mechanism so as to supply a driving control signal for controlling the movement of the needle to the driving mechanism, an ink supply mechanism adapted to supply ink to the distal end portion of the needle on the recording sheet side so that the ink attaches to the distal end portion when the needle is located in the rest position, an electrode disposed in another side of the recording paper and facing the distal end portion of the needle, and voltage control unit for applying between the needle and the electrode an ink flying voltage with respect to the supply of the driving control signal from the driving control unit to the driving mechanism the ink flying voltage generating between the needle and the electrode an ink flying electric field of an intensity such that the ink is drawn from the distal end portion of the needle to the recording paper to form an ink dot on the recording paper as the needle closes to the electrode than in the rest position.

7 Claims, 12 Drawing Sheets

INK-DOT PRINTER

BACKGROUND OF THE INVENTION

The present invention relates to an ink-dot printer which comprises at least one needle movable between a rest position remote from a recorded medium and a projected position close to the recorded medium, and driving means for moving the needle between the rest position and the projected position, and is constructed so that ink is supplied to and attached on the distal end portion of the needle on the recodded medium side when the needle is located in the rest position, and that the ink is moved from the distal end portion of the needle to the recorded medium to form an ink dot on the recorded medium when the needle moves to close to the recorded medium than in the rest position, thus forming a character or figure consisting of an aggregate of ink dots on the recorded medium.

Conventional ink-dot printers of this type are provided with ink film forming means serving as ink supply means, which includes a pair of pole plates disposed parallel to each other so as to define a vertically extended slit, an ink tank containing magnetic ink in which the lower end portions of the two pole plates are immersed, and exciting means for exciting the pole plates to draw the magnetic ink from the ink tank into the slit, thereby forming a magnetic ink film in the slit.

In this arrangement, the distal end of the needle in the rest position is located in the slit, so that the magnetic ink forming the film in the slit attaches to the distal end.

In these prior art ink-dot printers, moreover, an ink dot is formed on a recording sheet, or the recorded medium, on a platen by moving the needle from the rest position to the projected position so that the distal end of the needle impacts on the recording sheet. However, the impact of the needle running into the recording sheet on the platen produces a very high noise.

SUMMARY OF THE INVENTION

The present invention is contrived in consideration of these circumstances, and is intended to provide an ink-dot printer capable of securely forming clear ink dots on a recorded medium without producing any substantial noise or misprints.

The above object of the invention is achieved by an ink-dot printer which comprises a recorded medium, at least one needle disposed in one side of the recorded medium and movable between a rest position remote from the recorded medium and a projected position close to the recorded medium, driving means for moving the needle between the rest position and the projected position, driving control means electrically connected to the driving means so as to supply a driving control signal for controlling the movement of the needle to the driving means, ink supply means adapted to supply ink to the distal end portion of the needle on the recorded medium side so that the ink attaches to the distal end portion when the needle is located in the rest position, an electrode disposed in another side of the recorded medium and facing the distal end portion of the needle, and voltage control means for applying between the needle and the electrode an ink flying voltage with respect to the supply of the driving control signal from the driving control means to the driving means, the ink flying voltage generating between the needle and the electrode an ink flying electric field of an intensity such that the ink is drawn from the distal end portion of the needle to the recorded medium to form an ink dot on the recorded medium as the needle approaches the electrode from the rest position.

With this arrangement, even though the needle in the projected position is spaced from the recorded medium in order to prevent impact producting noise, the ink attaching to the distal end portion of the needle can securely be drawn to the electrode or the recorded medium as the needle moves from the rest position toward the recorded medium by applying voltages of different polarity between the electrode and the needle to generate a high-intensity electric field between them. Thus, clear ink dots can be formed on the recorded medium. Moreover, the ink attaching to the distal end portion of the needle cannot fly to the electrode or the recorded medium unless the needle moves from the rest position toward the recorded medium. Therefore, the needle in the rest position will never allow the ink to fly to the electrode or the recorded medium, obviating the possibility of misprints.

Preferably, in the ink-dot printer of the present invention constructed in this manner, the voltage control means applies the ink flying voltage between the needle and the electrode when the needle moves between the rest position and the projected position.

With this arrangement, the ink flying voltage is not applied between the needle and the electrode when the needle is in the rest position, so that misprints can more surely be prevented.

In the ink-dot printer of the invention, moreover, the voltage control means preferably applies the ink flying voltage between the needle and the electrode so as to produce the ink flying electric field when the needle reaches the projected position.

With this arrangement, the ink attaching to the distal end portion of the needle can be drawn to the electrode or the recorded medium when the needle reaches the projected position, that is, when it is located closest to the electrode. Thus, power consumption can be reduced, as compared with the case where the ink flying voltage is applied between the needle and the electrode so as to produce the ink flying electric field before the needle reaches the projected position.

In the ink-dot printer of the invention, furthermore, the voltage control means preferably applies the ink flying voltage between the needle and the electrode so as to produce the ink flying electric field when the needle starts to move from the projected position toward the rest position.

With this arrangement, when the needle starts to move from the projected position toward the rest position, the ink attaching to the distal end portion of the needle is separated from the distal end portion of the needle by the force of inertia which is produced by the movement of the needle from the rest position to the projected position. It is therefore possible to reduce the power consumption required in flying the ink from the distal end portion of the needle to the electrode or the recorded medium, as compared with the case where the ink flying voltage is applied between the needle and the electrode so as to produce the ink flying electric field before the needle reaches the projected position.

In the ink-dot printer of the invention, moreover, when the needle is in the rest position, the voltage control means preferably applies between the needle and the electrode a base voltage which generates between the needle and the electrode a base electric field of an intensity such that the ink is prevented from being drawn from the distal end portion of the needle to the recorded medium whether the needle is located in the rest position or the projected position.

With this arrangement, the ink can be forced to attach to the distal end portion of the needle in the rest position, so that the same needle can be used repeatedly without causing a shortage of ink supply to the distal end portion of the needle in the rest position. Thus, the ink dots formed on the recorded medium can be prevented from being blurred or reduced in diameter.

In the ink-dot printer of the invention, moreover, where the voltage control means applies the base voltage between the needle and the electrode when the needle is at the rest position, and applies the ink flying voltage between the needle and the electrode so as to produce the ink flying electric field when the needle reaches the projected position, as described above, it is preferable that the voltage control means applies the bas voltage between the needle and the electrode during the movement of the needle between the rest position and the projected position, and applies the ink flying voltage, by superimposing a supplemental voltage on the base voltage, between the needle and the electrode to produce the ink flying electric field when the needle reaches the projected position.

With this arrangement, as mentioned before, the ink attaching to the distal end portion of the needle can be drawn to the electrode or the recorded medium when the needle reaches the projected position, that is, when it is located closest to the electrode. Thus, electric power consumption to be needed for drawing the predetermined amount of magnetic ink attached on the distal end portion to the recorded medium can be reduced, as compared with the case where the ink flying voltage is applied between the needle and the electrode before the needle reaches the projected position. Also, the ink can be forced to attach to the distal end portion of the needle in the rest position, so that one and the same needle can be used repeatedly without causing a shortage of ink supply to the distal end portion of the needle in the rest position. Thus, the ink dots formed on the recorded medium can be prevented from being blurred or reduced in diameter.

In the ink-dot printer of the invention, moreover, where the voltage control means applies the base voltage between the needle and the electrode when the needle is at the rest position, and applies the ink flying voltage between the needle and the electrode so as to produce the ink flying electric field when the needle reaching the projected position starts to move from the projected position to the rest position, as described above, it is preferable that the voltage control means applies the base voltage between the needle and the electrode during the movement of the needle between the rest position and the projected position, and applies the ink flying voltage, by superimposing a supplemental voltage on the base voltage, between the needle and the electrode to produce the ink flying electric field when the needle reaching the projected position starts to move from the projected position to the rest position.

With this arrangement, the ink can be forced to attach to the distal end portion of the needle in the rest position, so that the same needle can be used repeatedly without causing a shortage of ink supply to the distal end portion of the needle in the rest position. Thus, the ink dots formed on the recorded medium can be prevented from being blurred or reduced in diameter. Further, as the ink attaching to the distal end portion separates from the distal end portion, by the force of inertia produced by the movement of the needle from the rest position to the projected position, when the needle reaching the projected position starts to move from the projected position to the rest position, power consumption to be needed for drawing the predetermined amount of magnetic ink attached to the distal end portion to the recorded medium can be reduced, as compared with the case where the ink flying voltage is applied between the needle and the electrode before the needle reaches the projected position.

In the ink-dot printer of the invention, furthermore, the voltage control means may be adapted to continue applying the ink flying voltage between the needle and the electrode while the driving control signal from the driving control means keeps on being applied to the driving means, and not to apply the ink flying voltage between the needle and the electrode when the driving control signal from the driving control means is not applied to the driving means.

With this arrangement, the ink flying voltage ceases to be applied between the needle and the electrode when the supply of the driving control signal from the driving control means to the driving means is stopped (i.e., when the printing operation is stopped), so that the ink-dot printer can be reduced in power consumption.

The ink-dot printer according to the embodiment of the present invention and its modifications will now be described in detail with reference to the accompanying drawings.

DETAILED DESCRIPTION OF THE PREFERRED EMBODIMENTS

Figure 1:
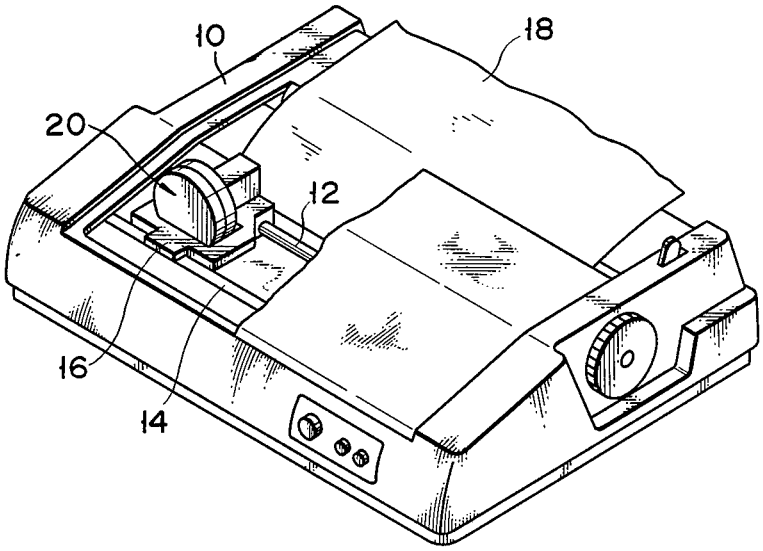
FIG. 1 is a cutaway perspective view of an ink-dot printer according to an embodiment of the present invention.

In an ink-dot printer according to an embodiment of the present invention shown in FIG. 1, a carriage shaft 12 and a guide shaft 14 are arranged parallel to each other in a housing 10. A carriage 16 is mounted on the carriage shaft 12 and the guide shaft 14 for reciprocation. The carriage 16 carries thereon a printing head 20 which faces a recording sheet 18 serving as a recorded medium.

Figure 2:
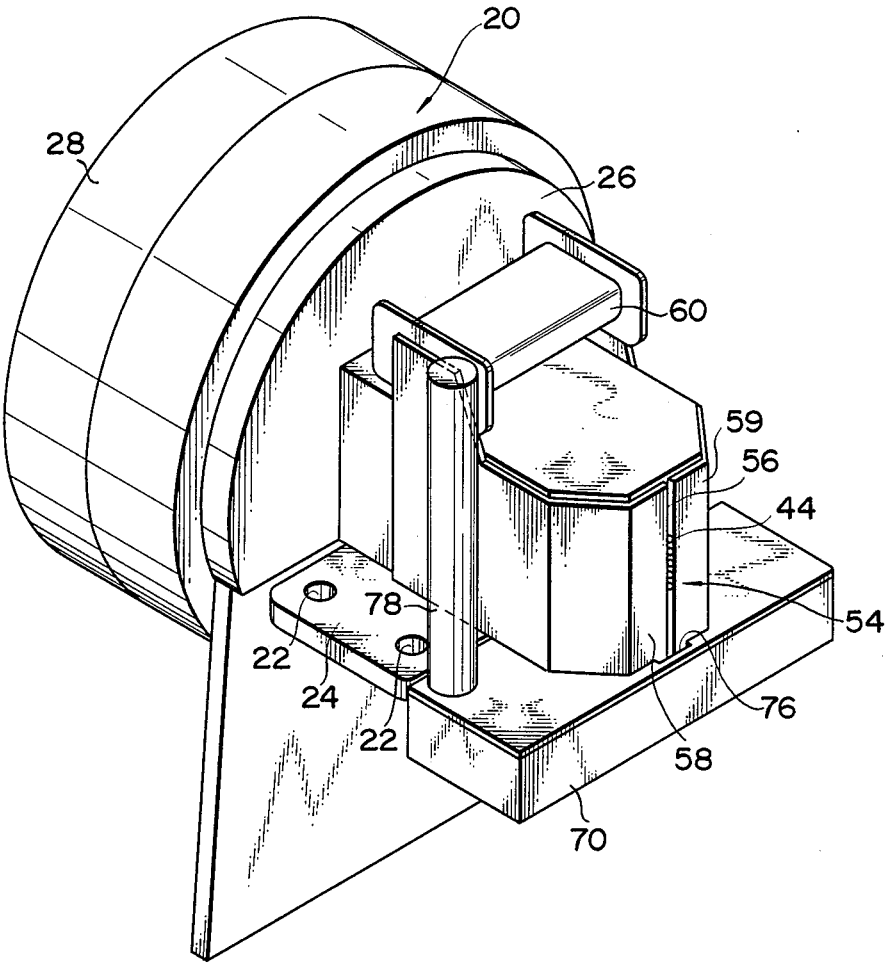
FIG. 2 is an enlarged perspective view showing a printing head of the ink-dot printer of FIG. 1.

As best seen from FIG. 2, the printing head 20 is provided with a head mounting member 24 having bolt holes 22 in which bolts are inserted to fix the head 20 on the carriage 16. The head mounting member 24 is fitted with a head cover 26. The head cover 26, which is formed of a synthetic resin, accomodates needle driving means 30 in its circular rear portion 28, as shown in FIG. 3.

Figure 3:
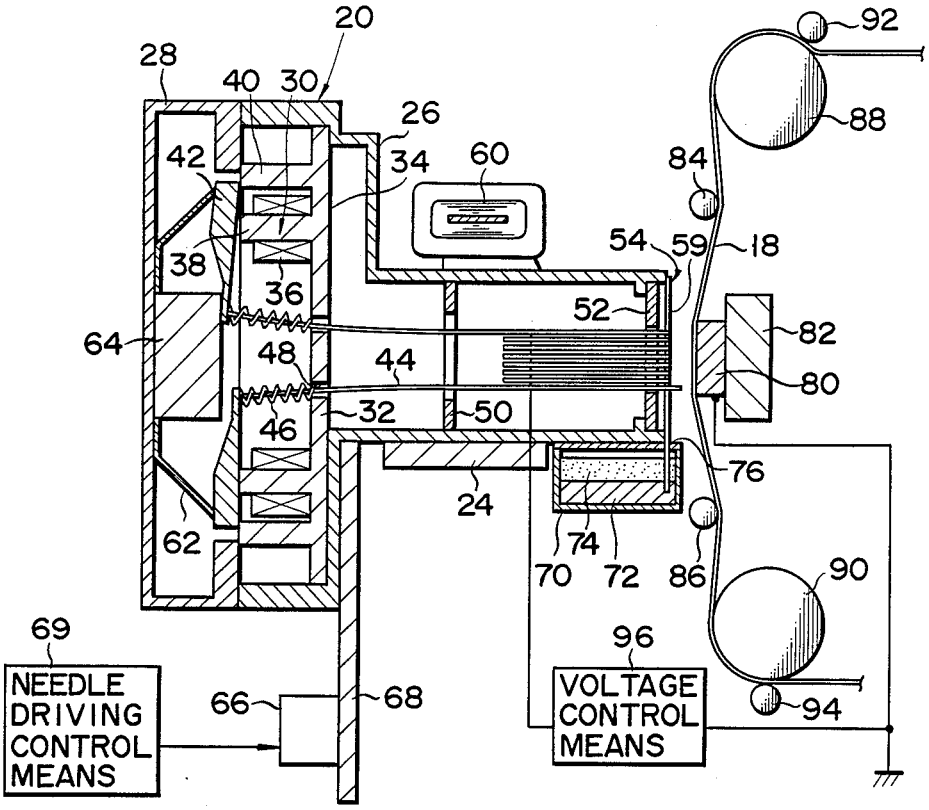
FIG. 3 is a vertical sectional view schematically showing the printing head, a recorded medium facing the head, and peripheral mechanisms for the recorded medium of the ink-dot printer of FIG. 1.
Figure 4:
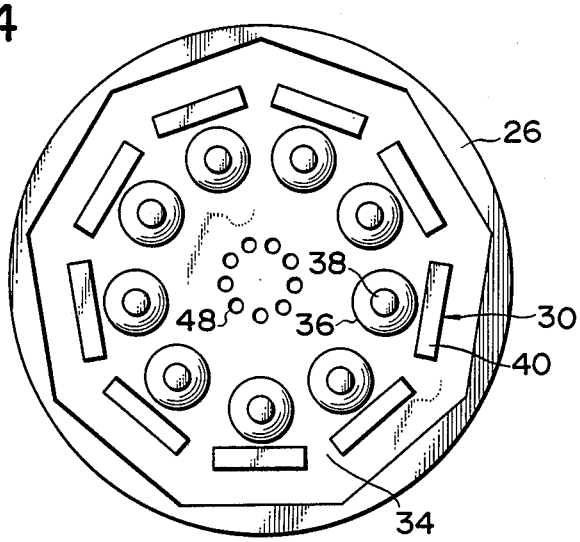
FIG. 4 is a rear view showing a magnetic member including cores and coils constituting electromagnets of needle driving means of the printing head of FIG. 3.

As shown in FIGS. 3 and 4, the needle driving means 30 includes a magnetic member 34 which, formed of a magnetic material, has a flat partition wall 32 attached to a stepped portion of the head cover 26. A plurality of cores 38 each wound with a coil 36 are formed in a circular arrangement on the partition wall 32. Yokes 40 are arranged individually outside the cores 38 in the radial direction.

As shown in FIG. 3, each yoke 40 is rotatably fitted with the basal part of an armature 42 which faces each corresponding core 38. The proximal end of a needle 44 is fixed to the distal end portion of each armature 42 with the aid of insulating means for preventing defective electrical insulation between the armature 42 and the needle 44. In this embodiment, a needle mounting portion at the distal end of the armature 42 is formed of an electrical insulation material, and the needles 44, which are nine in number, are made of an electrically conductive, nonmagnetic material, e.g., stainless steel, and have a diameter of approximately 0.2 mm. As shown in FIG. 3, a needle spring 46 is wound around each needle 44 between the partition wall 32 of the needle driving means 30 and each corresponding armature 42. The armatures 42, along with the needles 44, are urged rearward (to the left of FIG. 3) from the head cover 26 by the needle springs 46. The needles 44 penetrate apertures 48 which are formed in a circular arrangement on the partition wall 32 of the magnetic member 34, as shown in FIG. 4, so that their distal ends reach ink film forming means 54 serving as ink supply means, guided by an intermediate guide 50 and an end guide 52 inside the head cover 26.

The ink film forming means 54 includes a pair of pole plates 58 and 59 disposed parallel to each other so as to define a vertically extending slit 56, as shown in FIG. 2, and an electromagnet 60 as exciting means is coupled to the rear end portions of the two pole plates 58 and 59 which extend rearward along the two side faces of the head cover 26. The circular portion 28 of the head cover 26, as shown in FIG. 3, further accomodates therein backup springs 62 for urging the armatures 42 in the returning direction and a stopper 64 for determining the return position of the armatures 42. The head cover 26 is fitted with a printed-wiring board 68 which has a connector 66 and is formed with an electric circuit for controlling the actuation of the coils 36 for the drive control of the needles 44. The electric circuit performs the actuation control in response to needle drive signals from needle driving control means 69 which is electrically connected to the circuit by means of the connector 66. In this embodiment, the voltage applied to the coils 36 ranges from about 12 to about 13 volts.

The ink film forming means 54 further includes a plastic ink tank 70 which is attached to the bottom portion of the front end of the head cover 26. The ink tank 70 contains an ink-impregnated material 72 and magnetic ink 74. The lower end portions of the two pole plates 58 and 59 are inserted in a hole 76 bored through the top wall of the ink tank 70, and immersed in the magnetic ink 74. As shown in FIG. 2, an ink cartridge 78 for replenishing the ink tank 70 with the magnetic ink 74 is removably mounted on the top surface of the ink tank 70.

Inside the housing 10 of the ink-dot printer, as shown in FIG. 3, an electrode 80 serving also as a platen is held by an electrode holder 82 so as to face the printing head 20. In this embodiment, the electrode 80 is made of copper, and an electrical insulating film of polyimide resin is formed on the contact surface of the electrode 80 to be in contact with the recording sheet 18. Both ends of the electrode 80 are supported on side plates (not shown) in the housing 10 by means of electrical insulating members (not shown).

Paper backup guide rollers 84 and 86 are disposed above and below the electrode 80, whereby the recording sheet 18 is brought closely into contact with the electrode 80. A paper feed roller 88 and a paper tension roller 90 are arranged above the paper backup guide roller 84 and below the paper backup guide roller 86. A paper feed backup roller 92 and a paper backup roller 94 are paired with the paper feed roller 88 and the paper tension roller 90.

Applied between the needle 44 and the electrode 80 is a voltage from a power source (not shown) which is controlled by voltage control means 96 so as to produce an electric field of a desired intensity. In this embodiment, the distal end face of each needle 44 is rounded, as shown in FIG. 5, in order to prevent electric discharge between the needle end face and the electrode 80.

In the ink-dot printer according to the embodiment of the invention constructed in this manner, when the electromagnet 60 of the ink film forming mean 54 is energized, the magnetic ink 74 in the ink tank 70 is drawn up into the slit 56 between the two pole plates 58 and 59 by the agency of a magnetic field generated in the slit 56. As a result, a magnetic ink film 98 of a predetermined thickness is formed as shown in FIG. 5. At this time, the end face of a distal end portion 100 of each needle 44 in the rest position is in contact with the inside of a film surface 102 of the magnetic ink film 98 on the side of the recording sheet 18. The moment the electromagnet 60 of the ink film forming means 54 is energized, the voltage control means 96 applies a base voltage between the needle 44 and the electrode 80 to produce a base magnetic field between them. In this embodiment, the base voltage keeps on being supplied while the needle 44 is moving between the rest position as shown in FIG. 5 and a projected position where the distal end portion 100 of the needle 44 is located close to the recording sheet 18, projected from th sheet-side film surface 102 of the magnetic ink film 98, as shown in FIG. 6. Whether the needle 44 is located in the rest position or the projected position, the magnetic ink cannot be directed from the end face of the distal end portion 100 of the needle 44 to the electrode 80 (or the recording sheet 18).

Figure 5:
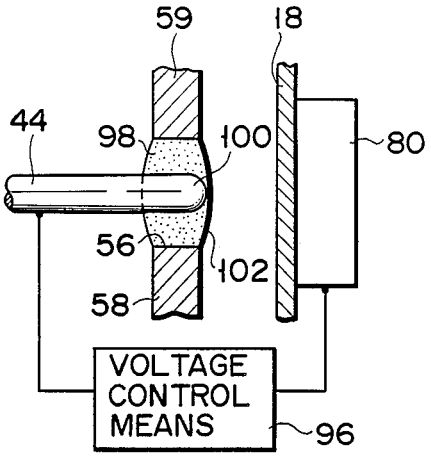
FIG. 5 is a sectional plan view schematically showing a needle in its rest position, in which the distal end portion of the needle is immersed in a magnetic ink film formed in a slit between a pair of pole plates of ink film forming means, and the end face of the distal end portion is in contact with the inside of the film surface of the magnetic ink film on the side of a recorded medium.
Figure 6:
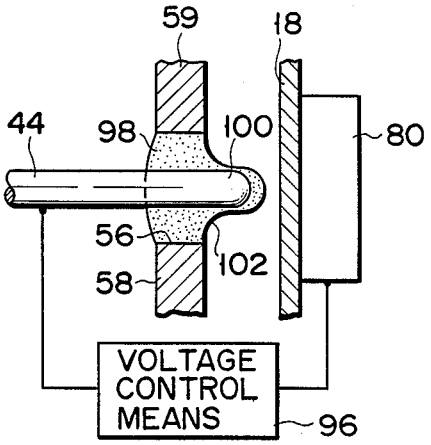
FIG. 6 is a sectional plan view similar to FIG. 5 schematically showing the needle in its projected position, in which the distal end portion of the needle is located close to the recorded medium, projected from the film surface of the magnetic ink film on the recorded medium side.

In this embodiment, when the needle 44 starts to move from the projected position shown in FIG. 6 toward the rest position shown in FIG. 5 after it is moved from the rest position to the projected position in response to a needle drive signal delivered from the needle driving control means 69, the voltage control means 96 superimposes a supplemental voltage on the base voltage to enhance the voltage applied between the needle 44 and the electrode 80. An enhanced electric field generated between the needle 44 and the electrode 80 by the enhanced voltage has an intensity such that the magnetic ink can be drawn from the distal end portion 100 of the needle 44 to the electrode 80 (or the recording sheet 18) as the needle 44 moves from the rest position toward the electrode 80. The enhanced voltage will hereinafter be referred to as ink flying voltage, and the enhanced electric field produced by the ink flying voltage as the ink flying electric field. When the needle 44 starts to move from the projected position to the rest position, a predetermined amount of ink attaching to the distal end portion 100 of the needle 44 is separated therefrom by the force of inertia which is produced by the movement of the needle 44 from the rest position to the projected position. The magnetic ink separated from the distal end portion 100 of the needle 44 is drawn to the electrode 80 (or the recording sheet 18) by the ink flying electric field, forming an ink dot of a predetermined size.

Figure 7:
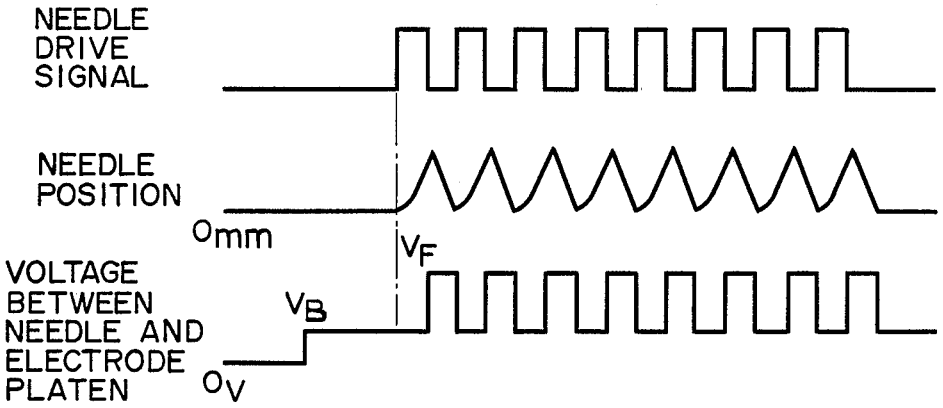
FIG. 7 shows time charts for needle drive signal, needle position, and voltage between needle and electrode of the ink-dot printer of FIG. 1.

FIG. 7 shows time charts for the needle drive signal, needle position, and voltage between needle and electrode platen in the embodiment described above. In the time chart for the voltage between the needle and the electrode platen, $V_B$ and $V_F$ indicate the base voltage and the ink flying voltage, respectively.

In the above-mentioned embodiment, the base voltage is applied between the needle 44 and the electrode 80 while the needle 44 is in the rest position shown in FIG. 5, so that a predetermined amount of ink is forced to attach to the distal end portion 100 of the needle 44 in the rest position. Therefore, even if the same needle 44 is repeatedly driven a number of times, as shown in FIG. 7, it is not feared that the amount of magnetic ink attaching to the distal end portion 100 of the needle 44 will become insufficient to render ink dots on the recording sheet 18 blurred or reduced in diameter.

Figure 8:
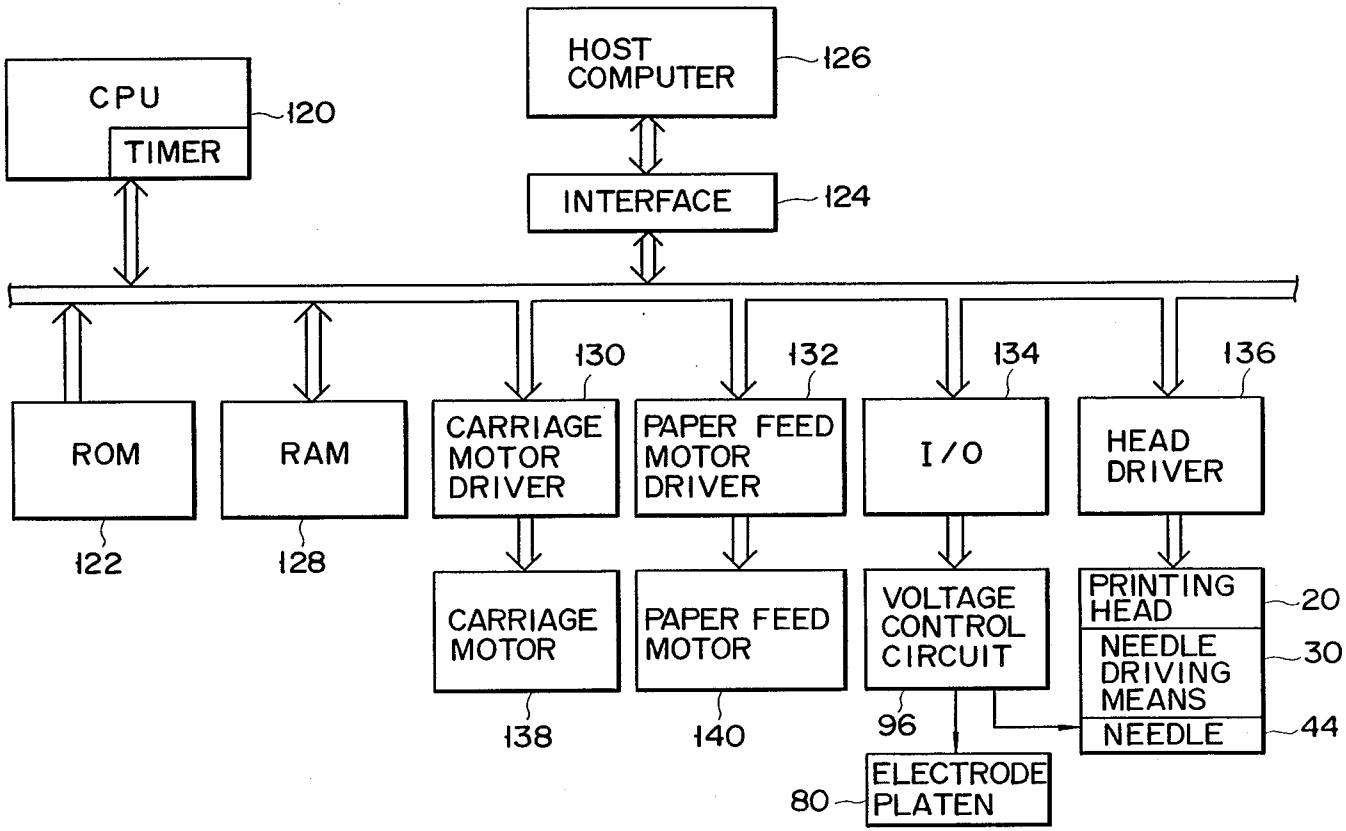
FIG. 8 is a diagram schematically showing a control circuit of the ink-dot printer of FIG. 1.

Referring now to FIG. 8, a control circuit of the ink-dot printer according to the above-mentioned embodiment will be described in brief. The control circuit comprises a central processing unit (CPU) 120, a read-only memory (ROM) 122 storing programs to be executed by the CPU 120 and character data, and a random access memory (RAM) 128 for temporarily storing control data transmitted from a host computer 126 through an interface 124 or printing control data obtained during program execution.

The CPU 120 is coupled with a carriage motor 138, a paper feed motor 140, the voltage control circuit 96, and the printing head 20 with the needle driving means 30 and the needles 44 through a carriage motor driver 130, a paper feed motor driver 132, an I/O port 134, and a head driver 136, respectively.

Figure 9:
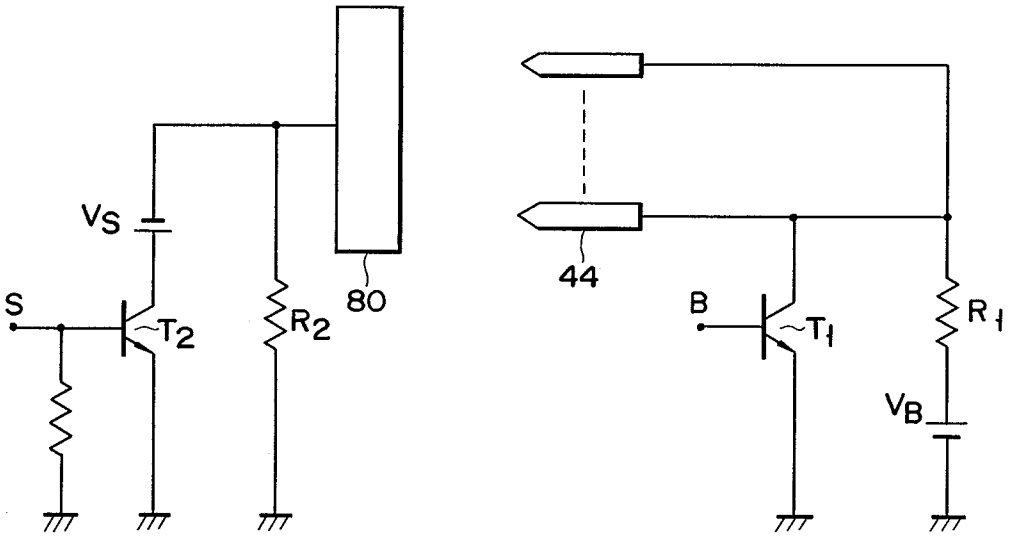
FIG. 9 is a diagram schematically showing a voltage control circuit included in the control circuit of FIG. 8.

FIG. 9 shows the voltage control circuit 96 used in the above described embodiment of the present invention. In FIG. 9, the needles 44 are not only grounded through a resistance $R_1$ and a base voltage source $V_B$ for the base voltage, but also connected to the collector of a transistor $T_1$. The base of the transistor $T_1$ is connected to a terminal B, while its emitter is grounded. The electrode platen 80 is not only grounded through a resistance $R_2$, but connected to the collector of a transistor $T_2$ through a supplemental voltage source $V_S$ for supplying the supplemental voltage which is superimposed on the base voltage to produce the ink flying voltage. The base of the transistor $T_2$ is connected to a terminal S and also grounded through another resistance. The emitter of the transistor $T_2$ is grounded.

In the voltage control circuit 96, base voltage applied to the terminals B and S of the transistors $T_1$ and $T_2$ are at high and low levels, respectively, until the electromagnet 60 of the film forming means 54 shown in FIG. 2 is energized. Accordingly, no electric field is produced between the electrode 80 and the needle 44.

When the electromagnet 60 of the ink film forming means 54 is energized, the base voltage applied to the terminal B of the transistor $T_1$ becomes low, and the base voltage applied to the terminal S of the transistor $T_2$ remains low. As a result, a base voltage of $+V_B$ is applied to the needle 44, and the aforesaid base field is produced between the electrode 80 and the needle 44.

Subsequently, before at least one of the needles 44 starts to move toward the rest position as shown in FIG. 5 after reaching the projected position as shown in FIG. 6, the base voltage applied to the terminal B of the transistor $T_1$ becomes low, while the base voltage applied to the terminal S of the transistor $T_2$ becomes high. As a result, base voltages of $-V_S$ and $+V_B$ are applied to the platen 80 and the needle 44, respectively, so that a relative bias of $V_A+V_B$ is applied between the needle 44 and the electrode 80. This relative bias is identical with the required ink flying voltage which produces the ink flying electric field between the needle 4 and the electrode 80. In this embodiment, when at least one of the needles 44 starts to move toward the rest position as shown in FIG. 5 after reaching the projected position as shown in FIG. 6, the ink flying electric field is produced.

Figure 10:
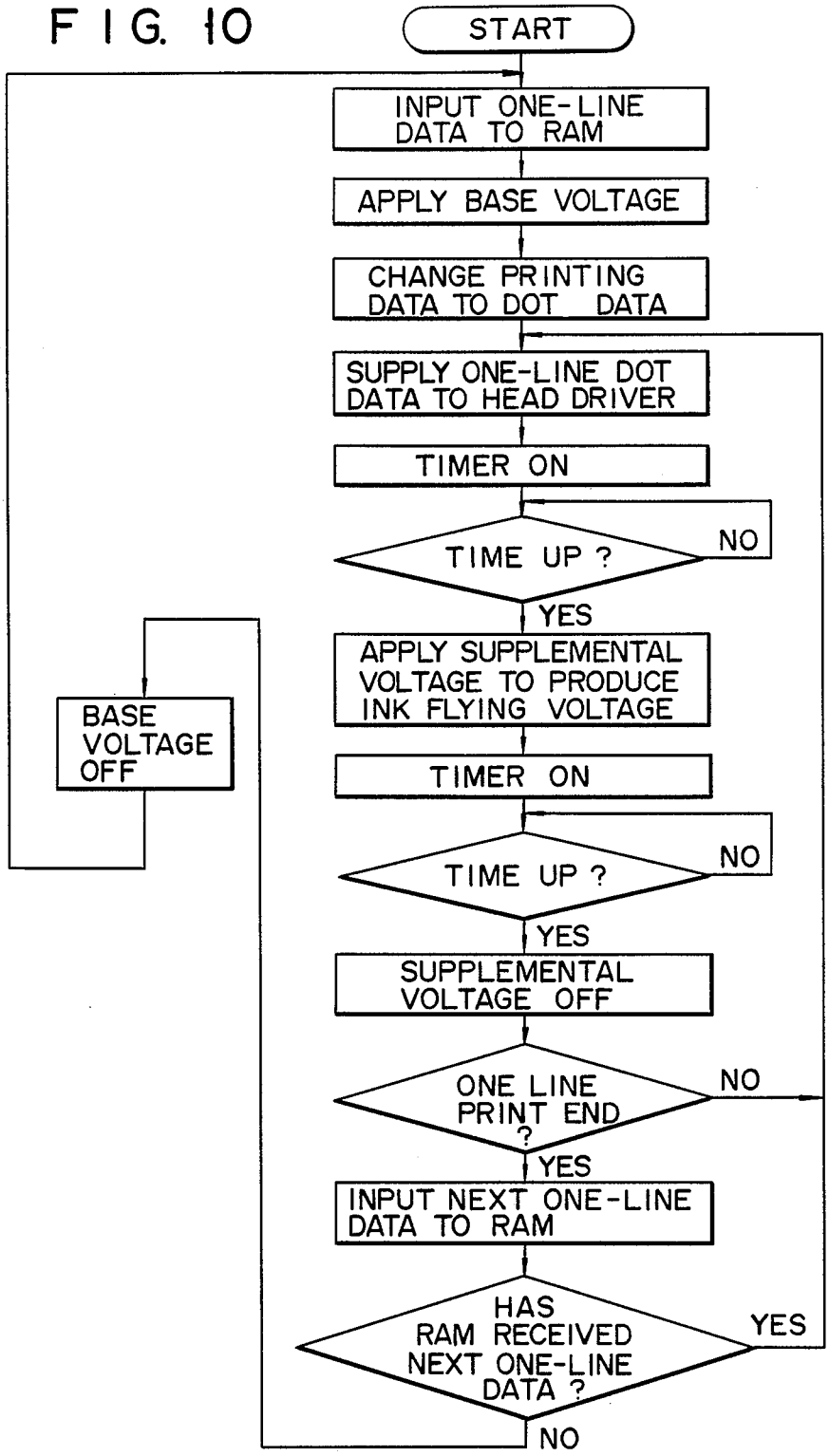
FIG. 10 is a flow chart for illustrating operations of the control circuit of FIG. 8.

Referring now to FIG. 10, the operation of the control circuit of FIG. 8 will be described.

First, when printing data for one line is supplied from the host computer 126 to the buffer of the RAM 128 through the interface 124, the base voltage is applied between the needles 44 and the electrode 80, and the printing data is changed to a dot data. Then, the dot data for one column out of dot data for one character is transmitted to the head driver 136, so that at least one needle 44 selected for the one column for printing of one character is moved from the rest position to the projected position. The moment the needle 44 starts to move in this manner, a timer of the CPU 120 is switched on to measure the predetermined time lapse which elapses from the instant that the needle 44 starts to move toward the projected position to the instant that the needle 44 reaches a predetermined position described herein after. When the lapse of the predetermined time is measured by the timer, the supplemental voltage is superimposed on the base voltage so that the ink flying voltage is applied between the needle 44 and the electrode 80 to generate the ink flying electric field between them. Needle 44 which is applied with the supplemental voltage for the ink flying voltage at the predetermined position described above starts to move from the projected position toward the rest position when the ink flying electric field is actually produced between the needle 44 and the electrode 80. Consequently, magnetic ink, which separates from the distal end portion 100 of the needle 44 by the force of inertia when the needle 44 starts from the projected position to the rest position, is drawn toward the electrode 80 (that is, toward the recording paper 18) by the ink flying electric field. Also when the supplemental voltage is superimposed, the timer of the CPU 120 is switched on, and measures the period of time when the ink flying electric field is being produced. When a predetermined time for the production of the ink flying electric field elapses, the superimposition of the supplemental voltage is stopped.

When the formation of ink dots for one column is repeated several times, shifting the location of the printing head 20 in the horizontal direction, printing for one character is completed. When the printing for one character is repeated several times, shifting the location of the priting head 20 in the horizontal direction, printing for one line corresponding to the dot data for one line supplied to the head driver 136 is accomplished.

When the printing for one line is completed, printing data for the next one line is tried to the inputted from the host computer 126 to the buffer of the RAM 128. If the buffer of the RAM 128 can be received the input of the printing data for the next one line, the aforesaid printing operation for one line is performed again. The base voltage keeps on being applied during this printing operation, that is, while the printing data is being supplied from the host computer 126 to the buffer of the RAM 128.

If the buffer of the RAM 128 is disabled from receiving the printing data for the next one line, then the desired printing operation is completed. Thereupon, the base voltage ceases to be applied, and the operation may be restarted.

It is to be understood that the present invention is not limited to the embodiment described above, and that various changes and modifications may be effected therein by one skilled in the art without departing from the scope or spirit of the invention.

For example, the base voltage $V_B$ may be applied only when the needle 44 is located in the rest position as shown in FIG. 5 so that the ink flying voltage $V_F$ is applied independently of the the base voltage $V_B$ while the needle 44 is moving between the rest position and the projected position.

In this case, it is preferable that the ink flying voltage $V_F$ is applied so as to produce the ink flying electric field when the needle 44 reaches the projected position and starts to move therefrom toward the rest position.

Figure 11:
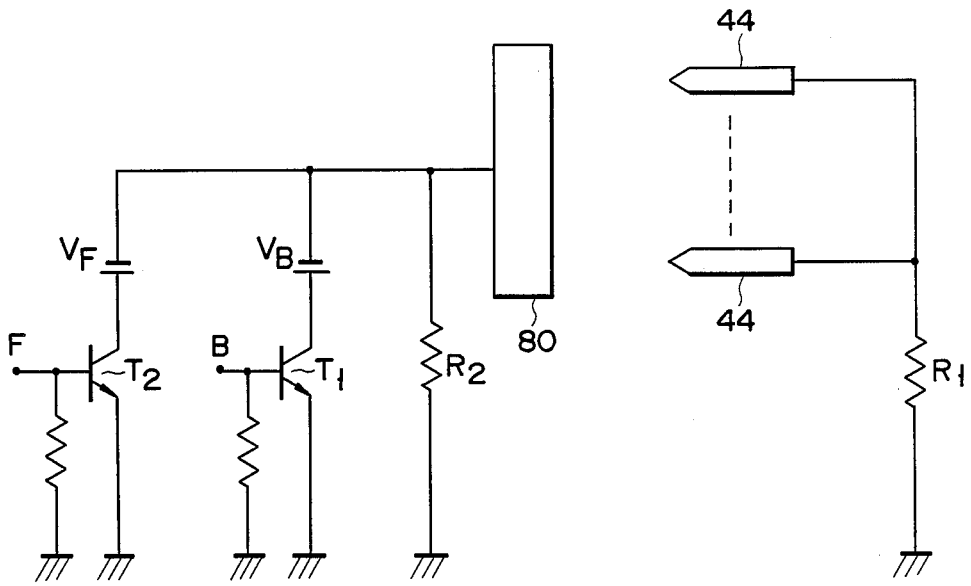
FIG. 11 is a diagram schematically showing a modified example of the voltage control circuit.

FIG. 11 shows a modified example of the voltage control circuit 96 for applying the ink flying voltage $V_F$ independently of the base voltage $V_B$. In FIG. 11, the individual needles 44 are grounded through the resistance $R_1$, and the electrode 80 is connected with the resistance $R_2$, the base voltage source $V_B$, and an ink flying voltage source $V_F$. The resistance $R_2$ is grounded, while the base voltage source $V_B$ and the ink flying voltage source $V_F$ are connected to the collectors of the transistors $T_1$ and $T_2$, respectively. The respective emitters of the transistors $T_1$ and $T_2$ are grounded, while their bases are grounded through their corresponding resistances and connected to terminals B and F, respectively.

In this modified example of the voltage control circuit 96, base voltage applied to the terminals B and F of the transistors $T_1$ and $T_2$ are at low level until the electromagnet 60 of the ink film forming means 54 shown in FIG. 2 is energized. Accordingly, no voltage is applied between the electrode 80 and the needle 44.

When the electromagnet 60 of the ink film forming means 54 is energized, the base voltage applied to the terminal B of the transistor $T_1$ becomes high, and the base voltage applied to the terminal F of the transistor $T_2$ remains low. As a result, a base voltage of $-V_B$ is applied to the electrode 80, and the aforesaid base electric field is produced between the electrode 80 and the needle 44.

Subsequently, at a suitable point of time during the period for the movement of at least one of the needles 44 between the rest position as shown in FIG. 5 and the projected position as shown in FIG. 6, the base voltage applied to the terminal B of the transistor $T_1$ becomes low, while the base voltage applied to the terminal F of the transistor $T_2$ becomes high. As a result, an ink flying voltage of $-V_F$ is applied to the electrode 80, so that the aforesaid ink flying electric field is produced between the electrode 80 and the needle 44. It is preferable that the ink flying voltage $V_F$ applied at the aforesaid suitable point of time produces the ink flying electric field when the needle 44 reaches the projected position and starts to move therefrom toward the rest position.

Figure 12:
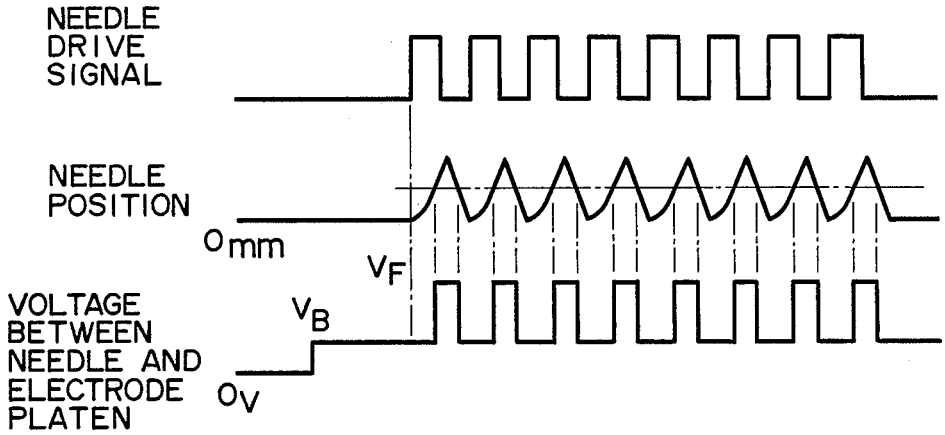
FIG. 12 shows time charts for needle drive signal, needle position, and voltage between needle and electrode of a first modification of the ink-dot printer of the invention.

According to the spirit of the present invention, the time for the supplemental voltage $V_S$ to be superimposed on the base voltage $V_B$ to produce the ink flying voltage $V_F$ in the voltage control circuit 96 of FIG. 9 or the time for the ink flying voltage $V_F$ to be applied independently of the base voltage $V_B$ in the voltage control circuit 96 of FIG. 11 may alternatively be changed to produce the ink flying electric field when the needle 44 reaches the projected position of FIG. 6, as shown in FIG. 12.

Figure 13:
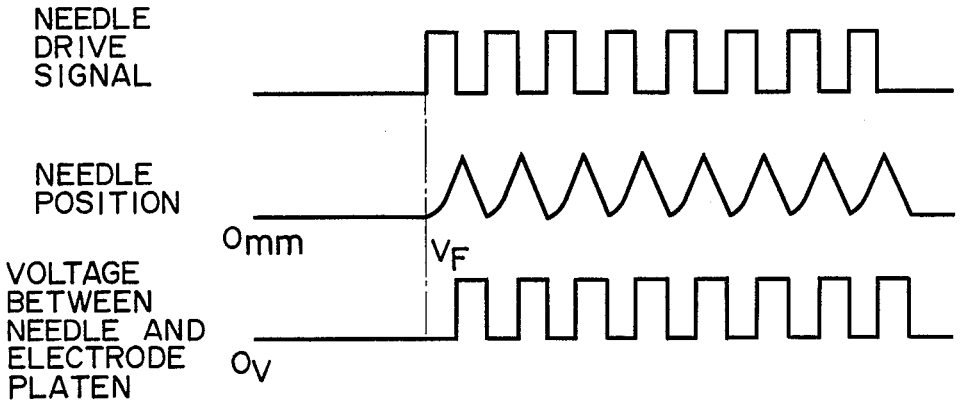
FIG. 13 shows time charts for needle drive signal, needle position, and voltage between needle and electrode of a second modification of the ink-dot printer of the invention.

According to the spirit of the invention, moreover, the ink flying voltage $V_F$ may be applied to produce the ink flying electric field when the needle 44 reaches the projected position and starts to move therefrom toward the rest position without applying the base voltage, as shown in FIG. 13.

Figure 14:
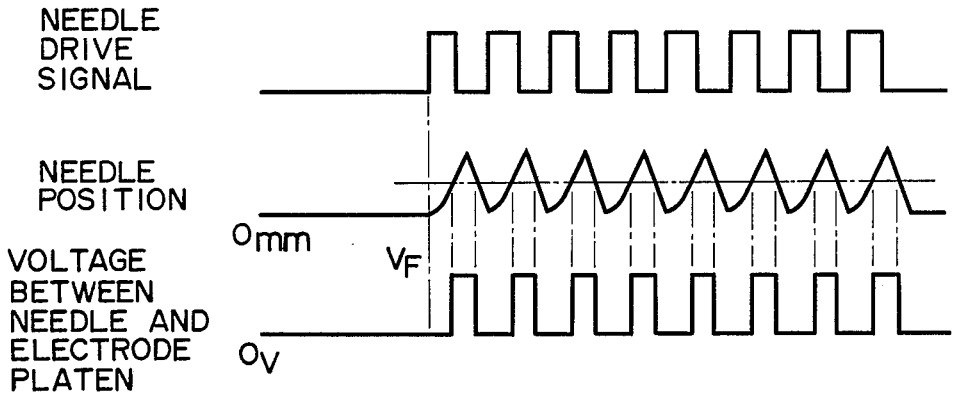
FIG. 14 shows time charts for needle drive signal, needle position, and voltage between needle and electrode of a third modification of the ink-dot printer of the invention.

According to the spirit of the invention, furthermore, the ink flying voltage $V_F$ may be applied to produce the ink flying electric field when the needle 44 reaches the projected position without applying the base voltage, as shown in FIG. 14.

Figure 15:
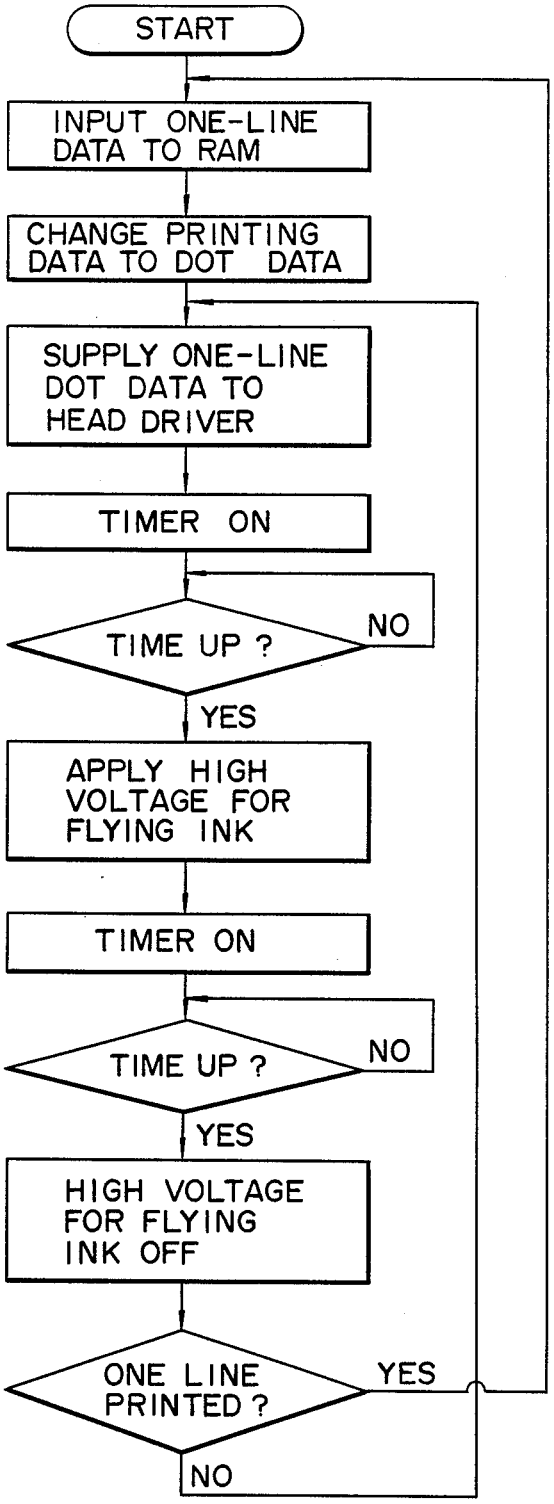
FIG. 15 is a flow chart for illustrating operations of the modifications shown in FIGS. 13 and 14.
Figure 16:
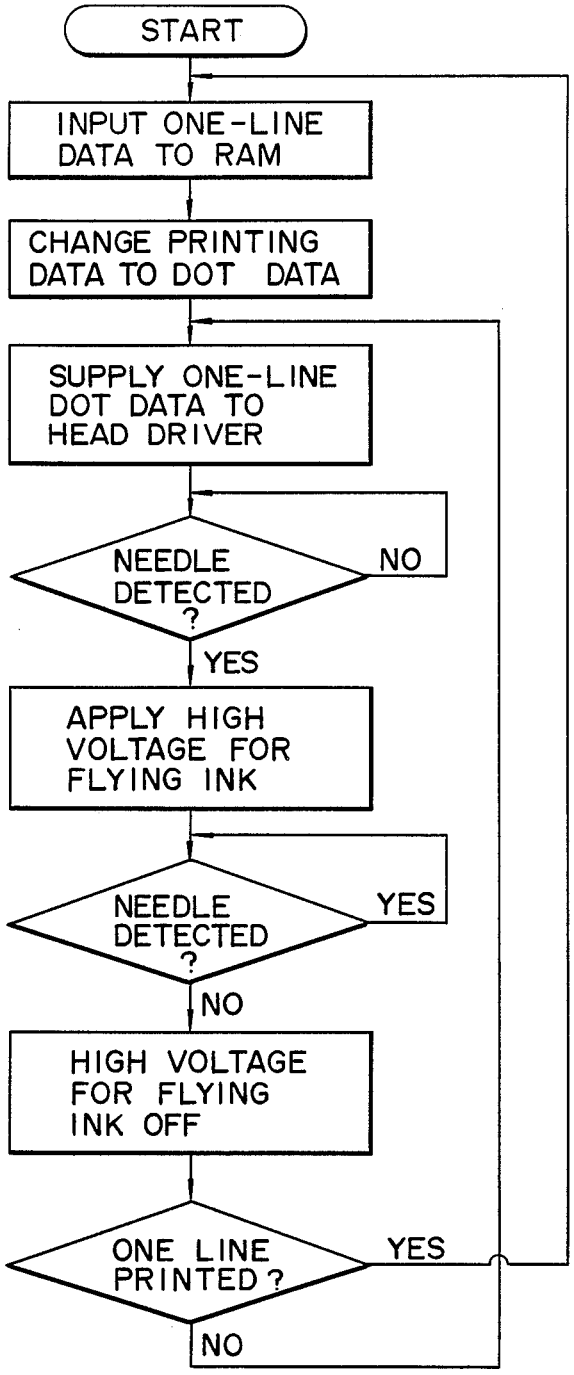
FIG. 16 is another flow chart for illustrating operations of the modifications shown in FIGS. 13 and 14.

FIGS. 15 and 16 show flows of controls in which the ink flying voltage $V_F$ which is independent of the base voltage $V_B$ is applied, as in the modifications showed in FIGS. 13 and 14, without applying the base voltage $V_B$ at a suitable point of time during the movement of the needle 44 between the rest position and the projected position.

In the flow chart of FIG. 15, when printing data for one line is supplied from the host computer 126 to the buffer of the RAM 128 through the interface 124, the printing date is changed to the dot data. Then, the dot data for one column out of dots data for one character is transmitted to the head driver 136, so that at least one needle 44 selected for the one column for printing of one character is moved from the rest position to the projected position. The moment the needle 44 starts the move in this manner, a timer of the CPU 120 is switched on to measure the predetermined time lapse which elapses from the instant that the needle 44 starts the move toward the projected position to the instant that the needle 44 reaches a predetermined position described hereinafter. When the lapse of the predetermined time is measured by the timer, the ink flying voltage $V_F$ is applied between the needle 44 and the electrode 80 to produce the ink flying electric field between them.

Also, when the ink flying voltage $V_F$ is applied, the timer of CPU 120 is switched on, and measures the period of time when the ink flying electric field is being produced. When a predetermined time for the production of the ink flying electric field is elapses, the application of the ink flying electric voltage is stopped.

When the formation of ink dots for one column is repeated several times, shifting the location of the printing head 20 in the horizontal direction, printing for one character is completed. When the printing for one character is repeated several times, shifting the location of the printing head 20 in the horizontal direction, printing for one line corresponding to the dot data for one line supplied to the head driver 136 is accomplished. And the flow of the flow chart returns to "start".

Flow chart of FIG. 16 is the same as that of FIG. 15 except that the timing of application of the ink flying voltage is determined not by the timer of CPU 120 but by a well known needle position sensor, such as constituted with a combination of a semiconductor laser and a phototransistor. That is, in the flow chart of FIG. 16, the needle 44 reaching the projected position is detected by the well known needle position sensor.

Further, according to the spirit of the invention, ink flying voltage $V_F$ may be continuously applied between the needle 44 and the electrode 80 during the continuation of supply of the printing data from the host computer 126 to the buffer of RAM 128.

The ink flying electric field produced between the needle 44 and the electrode 80 by the ink flying voltage described above can not draw the magnetic ink from the distal end portion 100 of the needle 44 when the needle 44 is in the rest position, but can draw the magnetic ink from the distal end portion 100 to the electrode, i.e. to the recording sheet 18, when the needle 44 approaches electrode 80 from the rest position.

Figure 17:
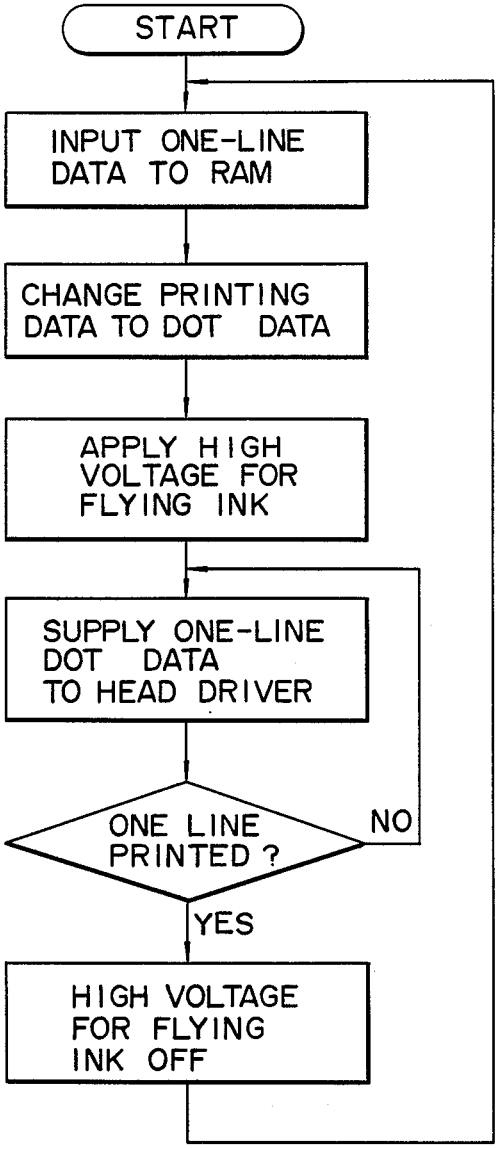
FIG. 17 is a flow chart for illustrating operations of a fourth modification of the ink-dot printer of the invention.

FIG. 17 shows a flow chart of printing process of the modification described above. In the flow chart of FIG. 17, when the printing data for one line is supplied from the host computer 126 to the buffer of the RAM 128 through the interface 124, the printing data is changed to a dot data. Then, the ink flying voltage is applied between the needle 44 and the electrode 80, so that the ink flying electric field is produced between them. The dot data for one column out of dot data for one character is transmitted to the head driver 136, so that at least one needle 44 selected for the one column for printing of one character is moved from the rest position to the projected position. A predetermined amount of magnetic ink is drawn, by the ink flying electric field described above, from the distal end portions 100 of the needle 44 reaching the projected position to the electrode 80 (i.e., to the recording sheet 18), so that a predetermined size of dot is formed on the recording sheet 18.

When the formation of ink dots for one column is repeated several times, shifting the location of the printing head 20 in the horizontal direction, printing for one character is completed. When the printing for one character is repeated several times, shifting the location of the printing head 20 in the horizontal direction, printing for one line corresponding to the dot data for one line supplied to the head driver 136 is accomplished.

When the printing for one line is completed the application of the ink flying voltage which produces the ink flying electric field between the needle 44 and the electrode 80 is stopped, and the flow of the flow chart returns to "start".

What is claimed is:

1. An ink-dot printer comprising:

a recorded medium;

at least one needle disposed one side of the recorded medium and movable between a rest position remote from the recorded medium and a projected position close to the recorded medium, driving means for moving the needle between the rest position and the projected position;

driving control means electrically connected to the driving means so as to supply to the driving means a driving control signal for controlling the movement of the needle;

ink supply means adapted to supply ink to a distal end portion of the at least one needle on the one side of the recorded medium so that the ink attaches to the distal end portion when the at least one needle is located in the rest position;

an electrode disposed on another side of the recorded medium and facing the distal end portion of the at least one needle; and voltage control means for applying between the at least one needle and the electrode an ink flying voltage while the at least one needle is moving between the rest position and the projected position so as to generate between the at least one needle and the electrode an ink flying electric field such as to cause the ink attached on the distal end portion of the at least one needle to be drawn from the distal end portion of the needle to the recorded medium to form an ink dot on the recorded medium while the at least one needle is moving between the rest position and the projected position.

2. The ink-dot printer according to claim 1, wherein said voltage control means, when the needle is in the rest position, applies between the needle and the electrode a base voltage which generates between the needle and the electrode a base electric field of an intensity such that the ink is prevented from being drawn from the distal end portion of the needle to the recorded medium whether the needle is located in the rest position or the projected position.

3. The ink-dot printer according to claim 2, wherein said voltage control means applies the base voltage between the needle and the electrode while the needle is moving between the rest position and the projected position, and said ink flying voltage applied between the needle and the electrode to generate the ink flying electric field therebetween when the needle reaches the projected position is obtained by superimposing a supplemental voltage on the base voltage.

4. The ink-dot printer according to claim 2, wherein said voltage control means applies the base voltage between the needle and the electrode while the needle is moving between the rest position and the projected position, and said ink flying voltage applied between the needle and the electrode to generate the ink flying field therebetween when the needle starts to move from the projected position toward the rest position is obtained by superimposing a supplemental voltage on the base voltage.

5. The ink-dot printer according to claim 1, wherein said voltage control means is adapted to continue applying the ink flying voltage between the needle and the electrode while the driving control signal from the driving control means keeps on being applied to the driving means, and not to apply the ink flying voltage between the needle and the electrode when the driving control signal from the driving control means is not applied to the driving means.

6. An ink-dot printer comprising:

a recorded medium;

at least one needle disposed on one side of the recorded medium and movable between a rest position remote from the recorded medium and a projected position close to the recorded medium;

driving means for moving the needle between the rest position and the projected position;

driving control means electrically connected to the driving means so as to supply to the driving means a driving control signal for controlling the movement of the needle;

ink supply means adapted to supply ink to a distal end portion of the at least one needle on the one side of the recorded medium so that the ink attaches to the distal end portion when the at least one needle is located in the rest position;

an electrode disposed on another side of the recorded medium and facing the distal end portion of the at least one needle; and voltage control means for applying between the at least one needle and the electrode an ink flying voltage when the at least one needle starts to move from the projected position toward the rest position so as to generate between the at least one needle and the electrode an ink flying electric field such as to cause the ink attached on the distal end portion of the at least one needle to be drawn from the distal end portion of the needle to the recorded medium to form an ink dot on the recorded medium when the at least one needle starts to move from the projected position toward the rest position.

7. The ink-dot printer according to claim 6, wherein said voltage control means, when the needle is in the rest position, applied between the needle and the electrode a base voltage which generates between the needle and the electrode a base electric field of an intensity such that the ink is prevented from being drawn from the distal end portion of the needle to the recorded medium whether the needle is located in the rest position or the projected position.

* * * * *